US005335972A

United States Patent [19]

Jensen

[11] Patent Number: 5,335,972

[45] Date of Patent: Aug. 9, 1994

[54] RECLINING CHAIR

[76] Inventor: Hans C. Jensen, 901 - 1600L Beach Ave., Vancouver, British Columbia, Canada, V6G 1Y6

[21] Appl. No.: 828,122

[22] Filed: Jan. 30, 1992

[51] Int. Cl.[5] ..... A47C 7/50

[52] U.S. Cl. ..... 297/423.19; 297/354.1

[58] Field of Search ..... 297/429, 432, 19, 30, 297/31, 16, 34, 271, 353, 354, 327, 16.1, 354.1, 354.13, 423.19, 423.21

[56] References Cited

U.S. PATENT DOCUMENTS

| | | | |
|---|---|---|---|
| 213,700 | 3/1879 | Smith | 297/432 X |
| 329,272 | 10/1885 | Cameron | 297/432 X |
| 482,745 | 9/1892 | Lewis | 297/429 X |
| 513,170 | 1/1894 | Armstrong | 297/432 |
| 3,137,528 | 6/1964 | Bottemiller | 297/429 |
| 3,292,830 | 12/1966 | Mack | 297/31 X |
| 4,046,419 | 9/1977 | Schmitt | 297/432 X |
| 4,212,495 | 7/1980 | Gall | 297/271 X |
| 4,534,594 | 8/1985 | Lucien | 297/429 X |

*Primary Examiner*—Jose V. Chen

*Attorney, Agent, or Firm*—Oyen Wiggs Green & Mutala

[57] ABSTRACT

A reclining chair has hinged back and seat portions. The back portion is supported on a first leg having a cam-shaped floor-engaging surface which rocks in relation to the floor but does not slide. The seat portion is supported on a wheeled leg which rolls over the floor toward and away from the first leg. Adjustment from a reclining to an upright position is simply achieved through movement of the user's weight. A control mechanism allows the user to release the seat and back for adjustment or fix the chair in a given orientation.

18 Claims, 5 Drawing Sheets

RECLINING CHAIR

TECHNICAL FIELD

The invention relates to furniture and in particular reclining chairs with attached footrests.

BACKGROUND ART

Reclining easy chairs are common in which, by means of various linkages, a footrest extends mechanically forwardly from a retracted position on a stationary base, the backrest tilts rearwardly and downwardly to a more horizontal orientation, and the seat slides forwardly when pressure is applied to the backrest. Such chairs are heavy and bulky. There are a number of variations on this basic design. See for example U.S. Pat. No. 4,212,495 issued to Gall which describes such a reclining chair in which the base moves away from an adjacent wall as the backrest is tilted downwardly. Again, such designs are complex, and cumbersome, with attendant costs of manufacture and problems of ongoing maintenance and mechanical breakdown.

There is therefore a need for a reclining chair which is easily moved from upright to reclining positions by the weight of the seated person, and avoids the mechanical complexity and weight of the prior art.

DISCLOSURE OF INVENTION

The present invention provides a reclining chair which comprises: a) a back-supporting member; b) a seat hingedly connected to the back-supporting member and having upper and lower surfaces; c) means for selectively allowing free pivotal movement between the back-supporting member and said seat and securing said seat and back in a fixed angular relationship; d) first support means for supporting the chair on a floor secured to the lower surface of the seat and comprising a floor-engaging end; and e) second support means for supporting the chair on the floor secured to the lower surface of the back-supporting member and comprising a floor-engaging end; wherein the floor-engaging end of the second support member comprises a lower cam surface adapted for non-sliding engagement with the floor surface and the other floor-engaging end is adapted for movement on the floor. Preferably the cam surface has a generally elliptical shape.

BRIEF DESCRIPTION OF DRAWINGS

In drawings which disclose a preferred embodiment of the invention.

BEST MODE(S) FOR CARRYING OUT THE INVENTION

Figure 2:
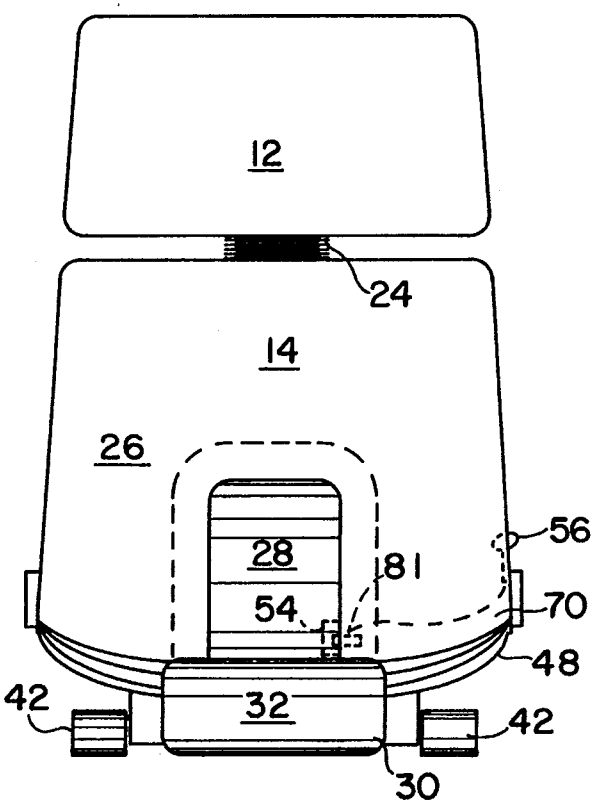
FIG. 2 is a rear view of the chair.

The chair 10 of the invention consists of a headrest 12, backrest 14, seat 16, and footrest 18. Each of the headrest 12, backrest 14, seat 16, and footrest 18 consist of a hollow moulded plastic shell 20 provided with a cushion insert 22 of leather-covered or cloth-covered foam rubber or the like. Headrest 12 is joined to backrest 14 by a stiff but flexible neck 24, made of a flexible metal alloy and provided with a series of parallel annular ribs such that the neck can be bent and the headrest moved to a desired angle with respect to the backrest by application of a bending force, but is rigid once set in a particular position.

Extending from and fixed to the rear surface 26 of backrest 14 is a hollow leg 28, also formed of moulded plastic, with the hollow interior of leg 28 opening into the hollow interior of back 20. Fixed at the end of leg 28 is a smooth-surfaced rocker foot 30 which is generally elliptical in cross-section, the major axis of the ellipse forming a slight angle to the plane formed by the surface of cushion 22 on backrest 14. Foot 30 is formed also of a moulded plastic, with a non-slip lower surface 32 of a rubberized fabric or the like.

Figure 8:
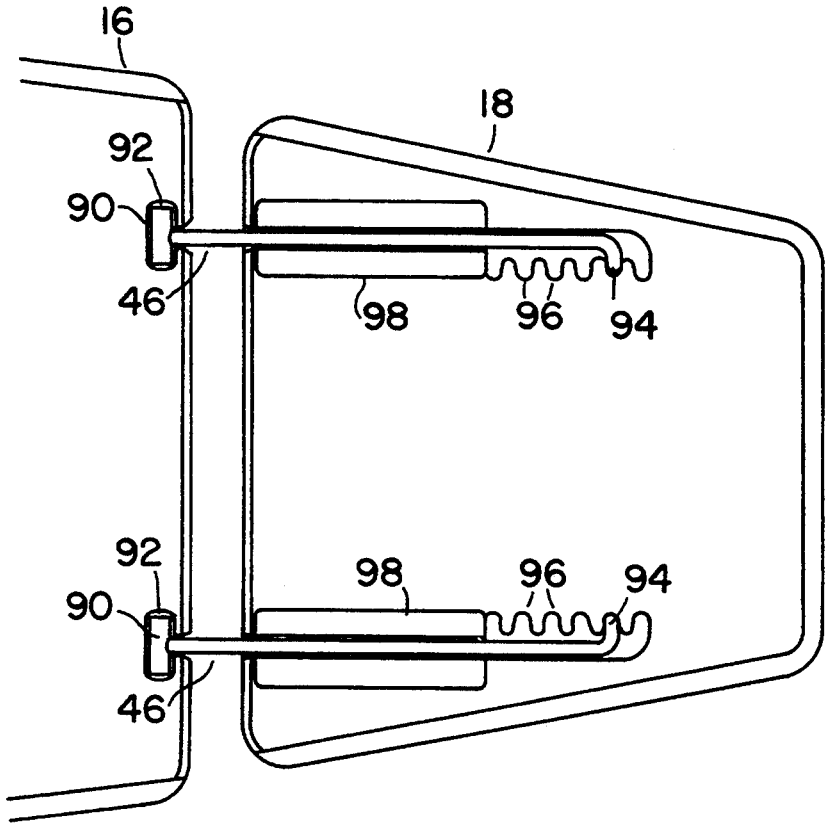
FIG. 8 is a top view of the footrest and a portion of the seat of the invention with the cushion inserts removed.
Figure 9:
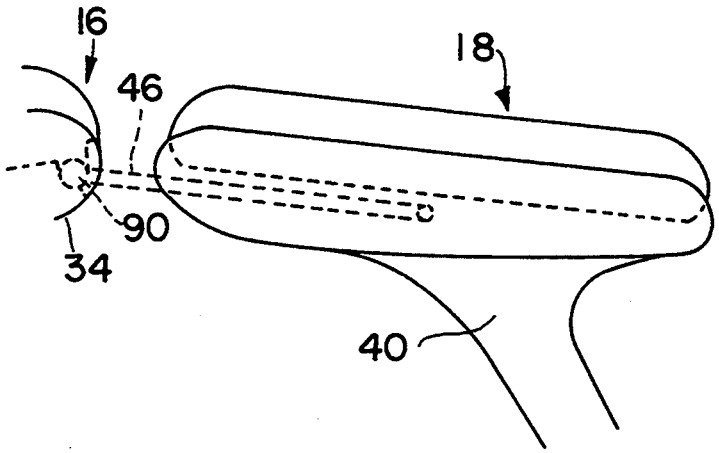
FIG. 9 is a side view of the footrest and a portion of the seat of the invention illustrating in phantom outline the adjustable connector bars.

Extending from and fixed to the lower surfaces 34, 36 of seat 16 and footrest 18 are legs 38, 40 which are also formed of moulded plastic. Mounted for rotation on axles at the end of leg 38 are two wheels 42. Two wheels 44 are mounted for rotation on an axle at the end of leg 40. Footrest 18 is joined to seat 16 by two pivoting connector bars 46, one end of which pivots in the plastic shell of seat 16 and the other end of which is adjustably secured in footrest 18. As shown in FIG. 8, bar 46 has a cylindrical end 90 which rotates in a cylindrical socket 92 in the shell of seat 16. The other end of bar 46 has a hooked end 94 which seats in notches 96 of the bar receptacle 98, formed of metal or plastic and secured to footrest 18. The distance of the footrest from the seat can thus be adjusted by positioning end 94 in different notches.

Backrest 14 and seat 16 are joined by hinges 50, 52, which are formed of hinge portion 51 of backrest 14, and 53 of seat 16, and are provided with a circular cover 55. An accordion-like flexible plastic surface 48 extends across the space between the back 26 of backrest 14 and back 34 of seat 16. A recline control mechanism 54, (shown in dotted outline in FIG. 2 and 3) operated by handle 56, holds the backrest 14 and seat 16 at a fixed angle until handle 56 is activated to release control 54 and allow relative rotation about hinges 50, 52.

Figure 1:
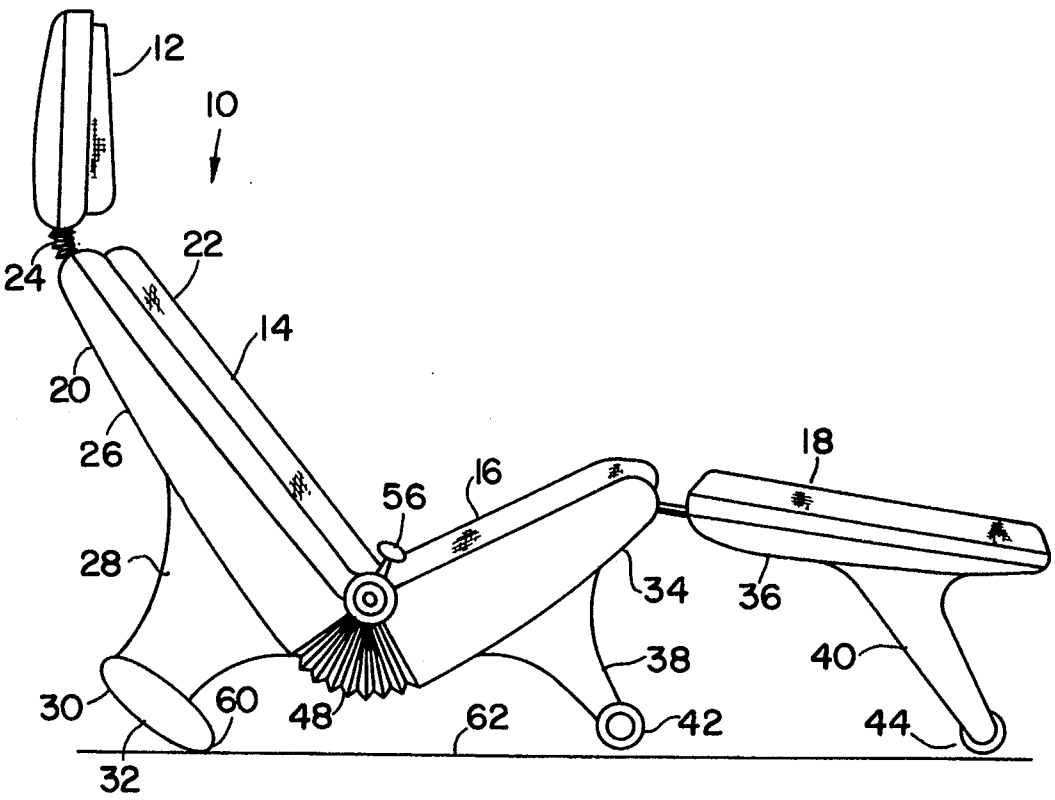
FIG. 1 is a side view of the chair in an upright position.
Figure 4:
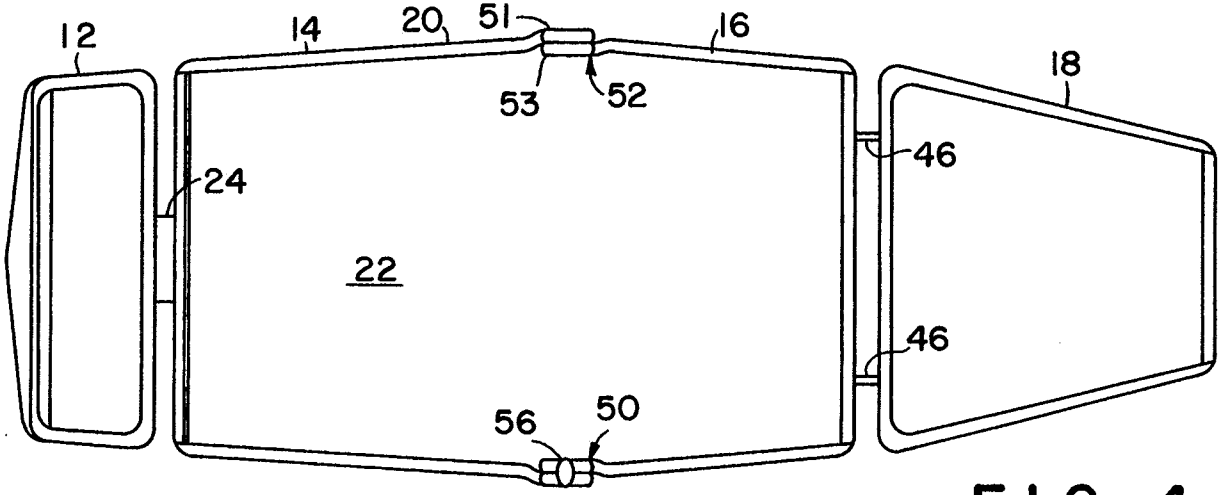
FIG. 4 is a top view of the chair.

In operation, in the upright position shown in FIG. 1, with recline control 54 holding the seat and backrest firmly in the position shown, the front toe 60 of rocker foot 30 is supporting the back of the chair on floor 62. Hinges 46 hold the footrest 18 at an acute angle to seat 16. Pulling on handle 56 releases the recline control to permit rotation between backrest 14 and seat 16. By extending his or her body, and applying force to the top of the backrest and end of the seat to straighten the angle between backrest 14 and seat 16, the user causes wheels 42 to roll closer to foot 30. Rocker foot 30 rolls on floor 62, without sliding, so that the flatter lower surface 32 now rests on floor 62. Accordion element 48 is compressed as the space between backs 26 and 34 is decreased. When the user has found the appropriate position, handle 56 is released to stop further rotation of hinges 50, 52. To return to the upright position, the process is reversed, with the user applying pressure to the hinge area of the seat and backrest to tilt the backrest forward and draw up the front of the seat.

By varying the relative geometric arrangement of rocker foot 30, hinges 50 and 52 and wheels 42, different characteristics of movement are given to the chair. Similarly, varying the shape and orientation of the cam surface 32 on rocker foot 30 will vary the position of the seated person in the upright and reclining positions. While a cylindrical shape, or even the shape of a plank, could operate in place of the preferred elliptical shape, the shape chosen provides a suitable upright sitting position and a smooth transition to a reclining position.

Figure 3:
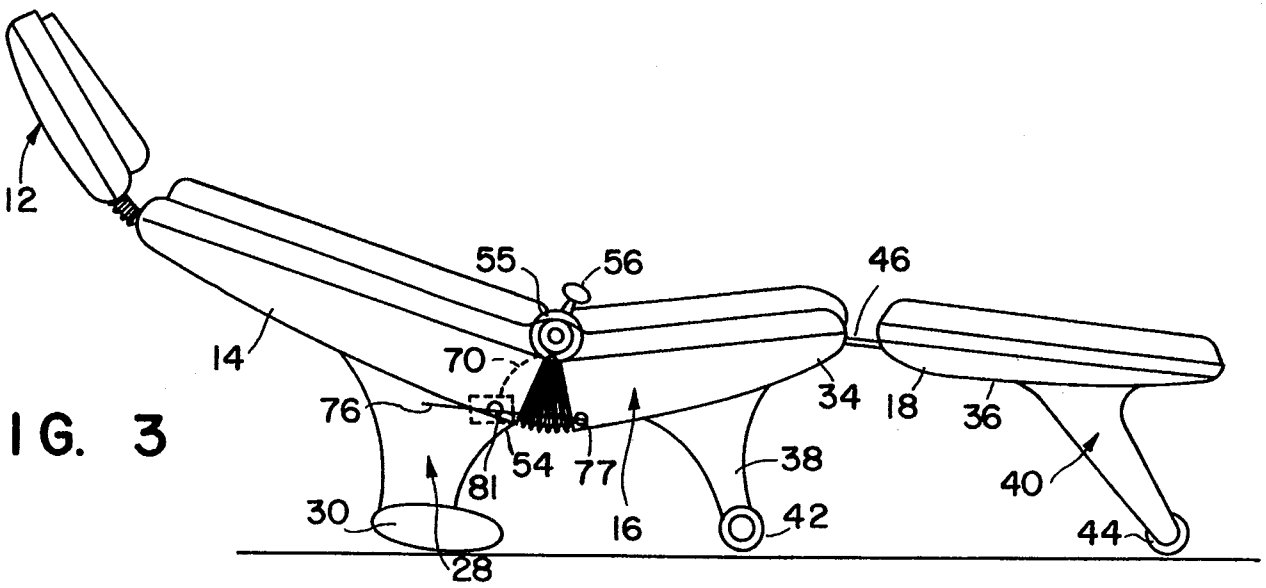
FIG. 3 is a side view of the chair in an reclining position.
Figure 5:
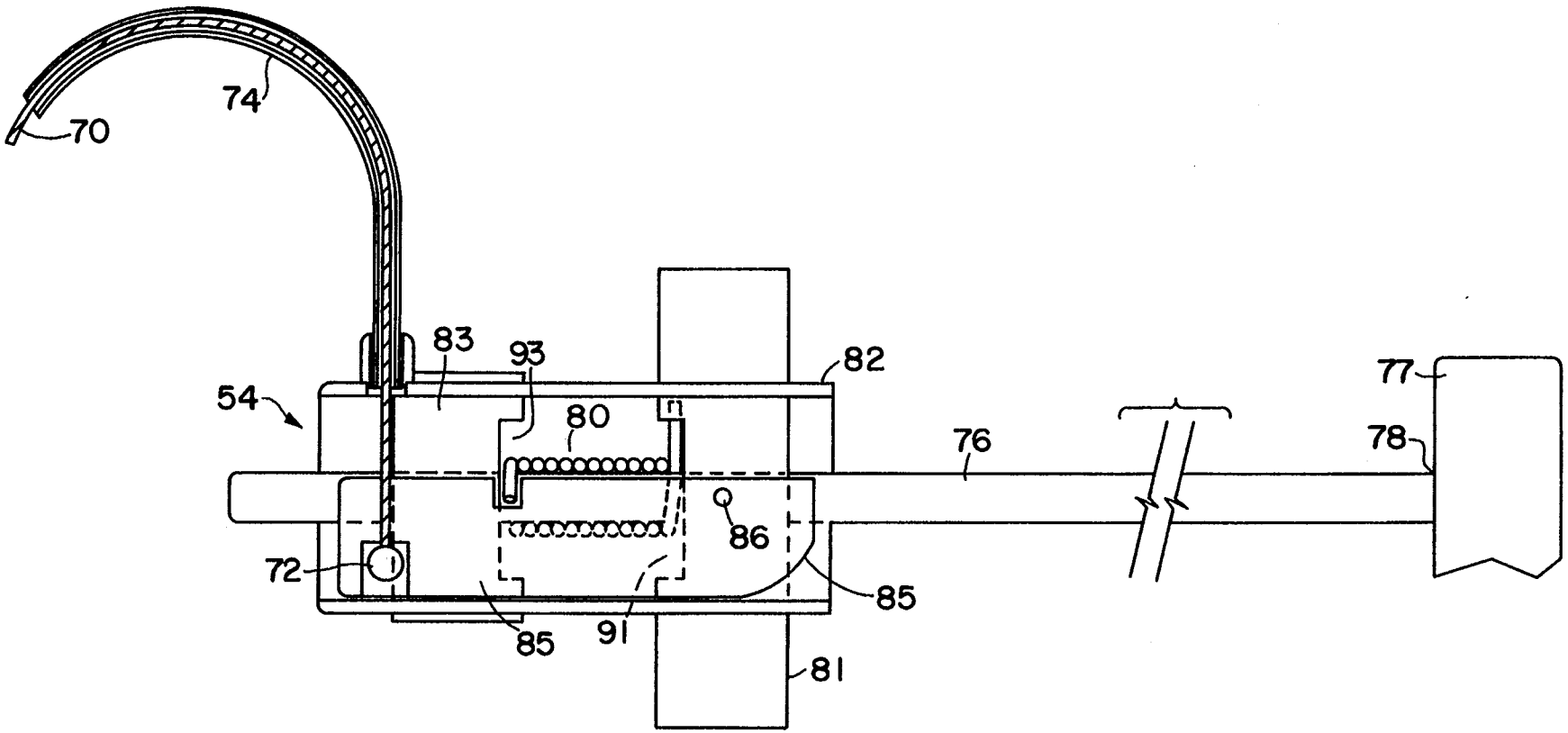
FIG. 5 is a cross-sectional view of the seat adjustment mechanism of the invention taken along line V—V of FIG. 6.
Figure 6:
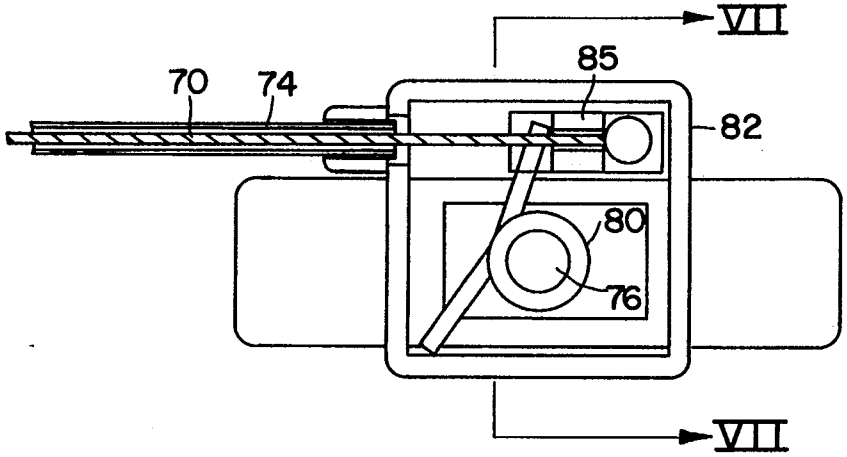
FIG. 6 is a cross-sectional view of the seat adjustment mechanism of the invention taken along line VI—VI of FIG. 7.
Figure 7:
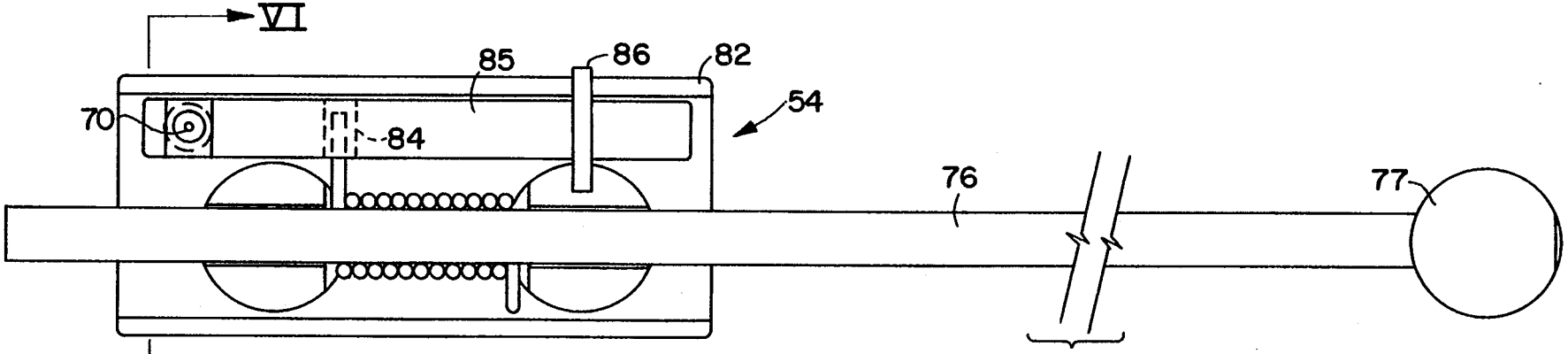
FIG. 7 is a cross-sectional view of the seat adjustment mechanism of the invention taken along line VII—VII of FIG. 6.

An example of one form of recline control for use in the invention is illustrated in FIGS. 5, 6 and 7. Handle 56 operates, like a bicycle brake, to shorten a length of flexible cable which has a flexible metal inner cable 70 held in a flexible sleeve 74. Cable 70 extends to control 54 (shown in dotted outline also in FIG. 2) and has a metal ball 72 fixed at one end thereof. A metal bar 76 is secured at one end to cylinder 77 by screw-threads or the like at 78, forming a T-shaped end. Cylinder 77 is mounted free to rotate about its longitudinal axis in a socket in the interior of seat 16. The other end of bar 76 extends through a hole in housing 82 and through cylinders 81 and 83. Cylinder 81 similarly is held free to rotate in a socket in the interior of backrest 14. Bar 76 extends through the centre of helical spring 80 mounted in body 82 with the ends of spring 80 sitting in cut-outs 91, 93 in cylinders 81, 83. One end 87 of spring 80 bears against the inside surface of body 82. The other end 89 sits in a groove 84 in pivot 85 which pivots about axis 86. When cable 70 is at rest, spring 80 forces pivot 85 to the position shown in FIG. 5–7 in which the helical spring tightly grips bar 76 and prevents it from sliding through the spring. When handle 56 pulls cable 76, ball 72 forces the free end of pivot 85 to pivot upwardly in FIG. 5, opening spring 80 and permitting bar 76 to slide through it. The end of bar 76 can then extend into the hollow interior of leg 28 as shown in FIG. 3. When handle 56 is released, spring 80 tightens on bar 76 to stop any sliding and thus stop any relative movement of seat and back rest.

As will be apparent to those skilled in the art in the light of the foregoing disclosure, many alterations and modifications are possible in the practice of this invention without departing from the spirit or scope thereof. For example, while the preferred form of the invention is shown to be provided with an attached footrest, it will be apparent to those skilled in the art that the principle of the invention can be utilized in a chair not having such footrest. Also, it will be apparent that the positions of rocker foot 32 and wheels 42 can be interchanged without affecting the manner of operation of the invention. Accordingly, the scope of the invention is to be construed in accordance with the substance defined by the following claims.

What is claimed is:

1. A reclining chair movable between an upright sitting and an extended reclining orientation comprising:

a) a back-supporting member having upper and lower surfaces;

b) a seat hingedly connected to said back-supporting member and having upper and lower surfaces;

c) means for selectively allowing free pivotal movement between said back-supporting member and said seat and securing said seat and back in a fixed angular relationship;

d) first support means for supporting said chair on a floor, said first support means being secured to the lower surface of said seat and comprising a floor-engaging end; and e) second support means for supporting said chair on said floor, said second support means being secured in fixed relationship to the lower surface of said back-supporting member and comprising a floor-engaging end mounted in fixed relationship to said second support means and said back-supporting member;

wherein said floor-engaging end of said second support means comprises a lower surface adapted for non-sliding area located towards said first support and having a first surface area located towards said first support means and a second surface area located away from said first support means and said floor-engaging end of said first support means is adapted for movement on said floor whereby when said chair if in said upright sitting orientation said back-supporting member is supported on said first surface area of said lower surface of said floor-engaging end of said second support means and said second surface area of said lower surface of said floor-engaging end of said second support means is raised above said floor, and when said chair is moved to said extended reclining orientation said second surface area of said lower surface of said floor-engaging end of said second support means moves downwardly into load-bearing contact with said floor and said floor-engaging end of said first support means is drawn towards said second support means.

2. The reclining chair of claim 1 further comprising a footrest flexibly secured at one edge thereof to said seat and comprising third support means secured to the lower surface of said footrest further comprising a floor-engaging end.

3. The reclining chair of claim 2 wherein said floor-engaging end of said third support means comprises a wheel.

4. The reclining chair of claim 2 wherein said cam surface comprises generally a portion of an ellipse.

5. The reclining chair of claim 1 wherein said lower surface of said floor-engaging end of said second support means comprises a cam surface.

6. The reclining chair of claim 1 wherein said floor-engaging end of said first support means comprises a wheel.

7. The reclining chair of claim 1 further comprising a headrest secured at one edge thereof to said back supporting means.

8. The reclining chair of claim 1 wherein said means for selectively allowing free pivotal movement between said back-supporting member and said seat and securing said seat and back in a fixed angular relationship comprises an elongated bar pivotally fixed at one end thereof to said seat and mounted in said back-supporting member adjacent the other end thereof in means for supporting and slidably receiving said bar, said means for supporting and slidably receiving said bar comprising a housing having a cylindrical passage for supporting and slidably receiving said bar and further comprising means for releasably gripping said bar.

9. The reclining chair of claim 8 wherein said means for releasably gripping said bar comprises handle means for alternately tightening or releasing cable means operable to open or release a helical spring having an inner diameter smaller than the other diameter of said bar and grippingly mounted in said cylindrical passage co-axially around said bar by applying pressure to variably open or release the coils of said spring.

10. A reclining chair movable between an upright sitting and an extended reclining orientation comprising:

a) a back-supporting member having upper and lower surfaces;

b) a seat hingedly connected to said back-supporting member and having upper and lower surfaces;

c) means for selectively allowing free pivotal movement between said back-supporting member and said seat and securing said seat and back in a fixed angular relationship;

d) first support means for supporting said chair on a floor, said first support means being secured to the lower surface of said back-supporting member and comprising a floor-engaging end; and e) second support means for supporting said chair on said floor, said second support means being secured in fixed relationship to the lower surface of said seat and comprising a floor-engaging end mounted in fixed relationship to said second support means and said seat;

wherein said floor-engaging end of said second support member comprises a lower surface adapted for non-sliding engagement with said floor surface and having a first surface area located towards said first support member and a second surface area located away from said first support and said floor-engaging end of said first support member is adapted for movement on said floor whereby when said chair if in said sitting orientation said seat is supported on said first surface area of said lower surface of said floor-engaging end of said second support member and said second surface area of said lower surface of said floor-engaging end of said second support member is raised above said floor, and when said chair is moved to said reclining orientation said second surface area of said lower surface of said floor-engaging end of said second support member moves downwardly into load-bearing contact with said floor and said floor-engaging end of said first support member is drawn towards said second support member.

11. The reclining chair of claim 16 further comprising a footrest flexibly secured at one edge thereof to said seat and comprising third support means secured to the lower surface of said footrest further comprising a floor-engaging end.

12. The reclining chair of claim 11 wherein said floor-engaging end of said third support means comprises a wheel.

13. The reclining chair of claim 16 wherein said floor-engaging end of said first support means comprises a wheel.

14. The reclining chair of claim 10 wherein said lower surface of said floor-engaging end of said second support member comprises a cam surface.

15. The reclining chair of claim 14 wherein said cam surface comprises generally a portion of an ellipse.

16. The reclining chair of claim 14 wherein said cam surface comprises generally a portion of an ellipse.

17. The reclining chair of claim 10 further comprising a headrest secured at one edge thereof to said back supporting means.

18. The reclining chair of claim 10 wherein said floor-engaging end of said first support meant comprises a wheel.

* * * * *

UNITED STATES PATENT AND TRADEMARK OFFICE

CERTIFICATE OF CORRECTION

PATENT NO. : 5,335,972

DATED : 9 August, 1994

INVENTOR(S) : JENSEN, Hans C.

It is certified that error appears in the above-identified patent and that said Letters Patent is hereby corrected as shown below:

Column 6,

Delete claim 16 and renumber claims 17 and 18 to be claims 16 and 17 respectively.

Signed and Sealed this

Tenth Day of January, 1995

Bruce Lehman

*Attest:*

BRUCE LEHMAN

*Attesting Officer*

*Commissioner of Patents and Trademarks*